US009688358B2

(12) United States Patent
Fuller, IV et al.

(10) Patent No.: US 9,688,358 B2
(45) Date of Patent: Jun. 27, 2017

(54) COMPANIONWAY CLOSURES FOR A BOAT

(71) Applicant: S2 Yachts Inc., Holland, MI (US)

(72) Inventors: Linwood Addison Fuller, IV, Vero Beach, FL (US); Dwayne Back, Cocoa, FL (US)

(73) Assignee: S2 Yachts, Inc., Holland, MI (US)

( * ) Notice: Subject to any disclaimer, the term of this patent is extended or adjusted under 35 U.S.C. 154(b) by 218 days.

(21) Appl. No.: 14/624,153

(22) Filed: Feb. 17, 2015

(65) Prior Publication Data

US 2015/0232151 A1 Aug. 20, 2015

Related U.S. Application Data

(60) Provisional application No. 61/942,282, filed on Feb. 20, 2014.

(51) Int. Cl.
*B63B 19/18* (2006.01)
*B63B 29/02* (2006.01)

(52) U.S. Cl.
CPC ..... *B63B 19/18* (2013.01); *B63B 29/02* (2013.01)

(58) Field of Classification Search
CPC ..... B60J 7/1642; B63B 19/18
See application file for complete search history.

(56) References Cited

U.S. PATENT DOCUMENTS 2,499,749 A * 3/1950 Hilliard ..... B60J 5/047 296/223
5,088,435 A * 2/1992 Lathers ..... B63B 19/18 114/177

* cited by examiner

*Primary Examiner* — Edwin Swinehart
(74) *Attorney, Agent, or Firm* — Price Heneveld LLP

(57) ABSTRACT

A sliding hatch for a boat including a vertical bulkhead and deck having an opening with vertical and horizontal sections defining a companionway for access to areas below the deck. A door is pivotally mounted to a bulkhead adjacent the vertical opening and movable for access to the vertical section of the companionway. A hatch is slideably mounted to the deck for selectively enclosing the horizontal section of the opening. Pivoted links couple the door to the hatch, such that, as the door is opened and closed, the hatch is moved between open and closed positions.

21 Claims, 8 Drawing Sheets

COMPANIONWAY CLOSURES FOR A BOAT

CROSS-REFERENCE TO RELATED APPLICATIONS

This application claims priority under 35 U.S.C. §119(e) and the benefit of U.S. Provisional Application No. 61/942,282 entitled COMPANIONWAY CLOSURES FOR A BOAT, filed on Feb. 20, 2014, by Dwayne Back et al., the entire disclosure of which is incorporated herein by reference.

BACKGROUND OF THE INVENTION

The present invention relates to a companionway door and hatch which are interconnected, such that opening and closing of the door simultaneously opens and closes the hatch for access to areas below the deck of a boat.

Larger boats typically have areas below deck for living or other accommodations. Access to the accommodations is typically through a companionway door which moves in a vertical plane to provide access through a vertical opening formed in a vertical bulkhead in the boat's bridge deck or cockpit. In order to provide head clearance for access below, frequently a secondary or sliding hatch is provided, which also must be moved to gain access to a ladder leading to the spaces below deck. This requires the operator to remember to open the hatch so as not to bump his or her head on the hatch. Also, with such hatches, it is typically necessary to provide a locking mechanism, such that, when in an open or closed position underway in rough seas, the hatch cannot slide closed. This somewhat cumbersome process requires two motions for the operator to gain access to the spaces below deck and, for safety, requires that both the door and companion hatch be securely locked in open and/or closed positions. It would be desirable to provide a system by which only one action is required of the boat user to simultaneously open the door and hatch, as well as allowing locking of one of the two members to secure the companionway opening when underway in rough sea conditions.

SUMMARY OF THE INVENTION

The system of the present invention satisfies this need by providing a sliding hatch for a boat having a bulkhead and deck with horizontal and vertical openings, which together define a companionway for access to areas below the deck. The opening has vertical and horizontal sections, and a door is pivotally mounted to a bulkhead adjacent the vertical opening and movable for access to the vertical section of the opening. A hatch is slideably mounted to the deck for selectively enclosing the horizontal section of the opening. Pivoted links couple the door to the hatch, such that, as the door is moved between closed and open positions, the hatch is also moved between closed and open positions.

These and other features, objects and advantages of the present invention will become apparent upon reading the following description thereof together with reference to the accompanying drawings.

DETAILED DESCRIPTION OF THE PREFERRED EMBODIMENT

Figure 1:
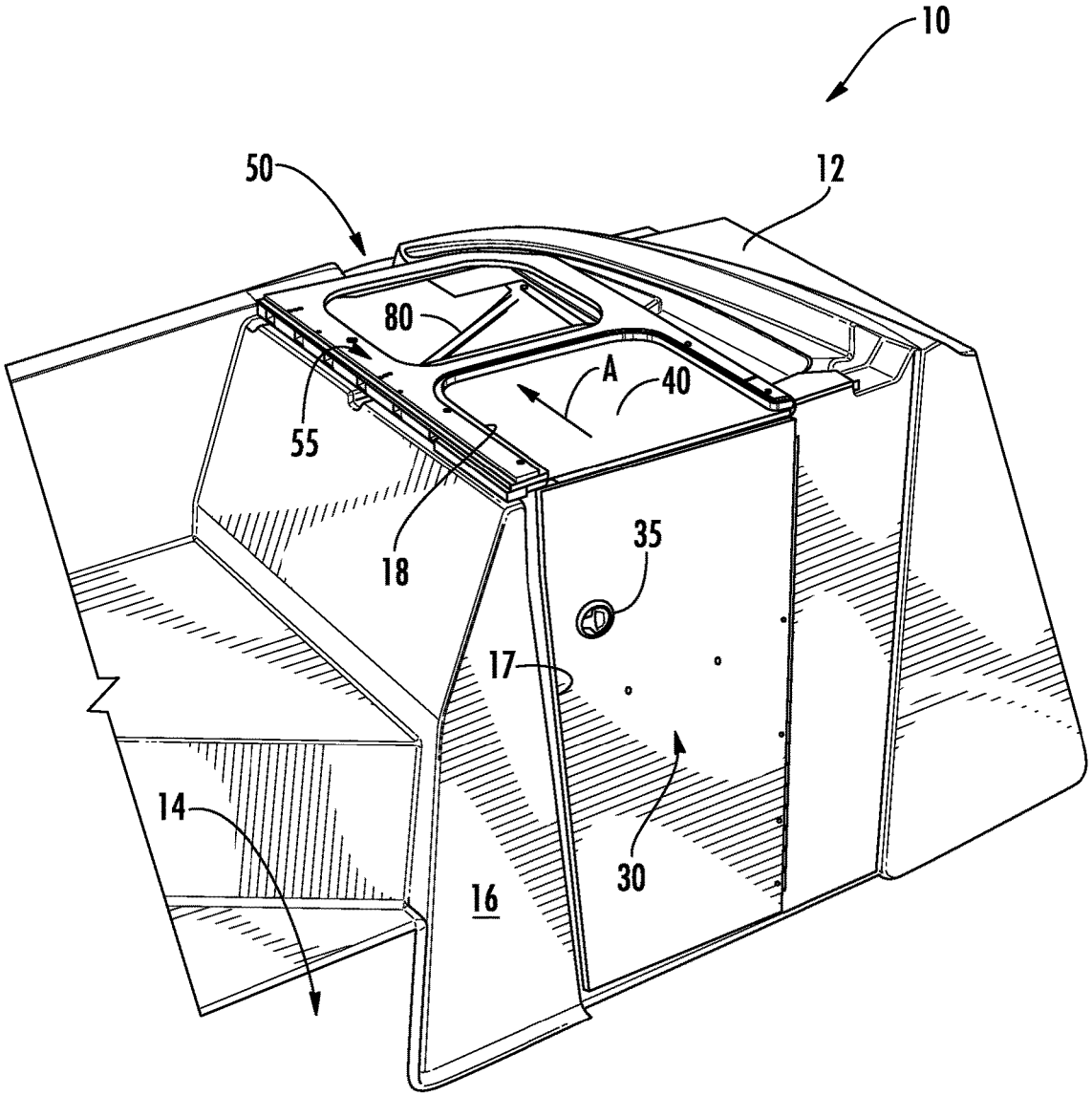
FIG. 1 is a fragmentary perspective pictorial diagram of a boat having a sliding hatch assembly which can be mounted to the deck of a boat and coupled to a companionway door for opening and closing the hatch with the movement of the door. In this view, the hatch and door are shown in the closed position.
Figure 2:
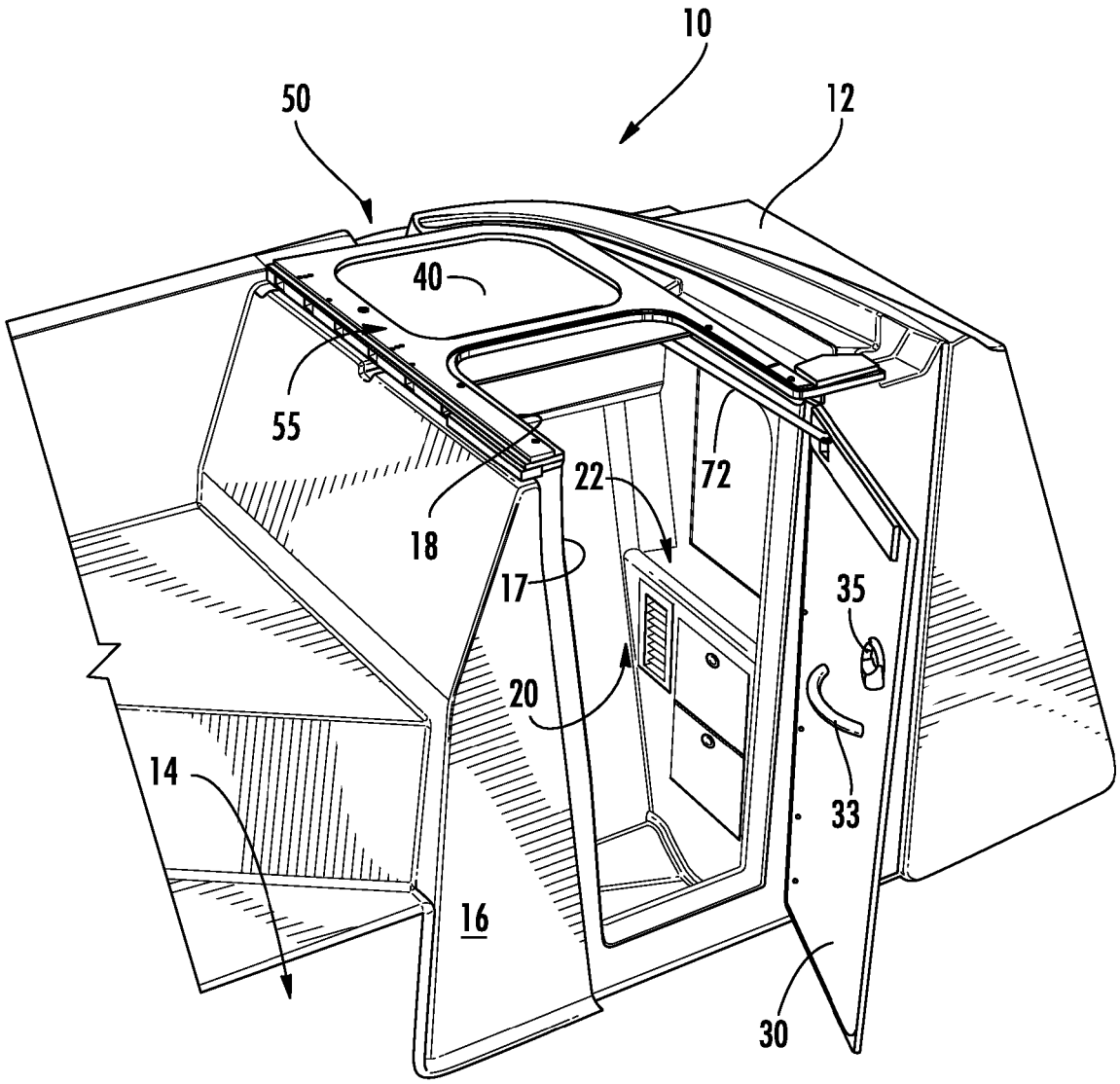
FIG. 2 is a view of the assembly shown in FIG. 1, shown with the hatch and door in a fully open position.
Figure 3:
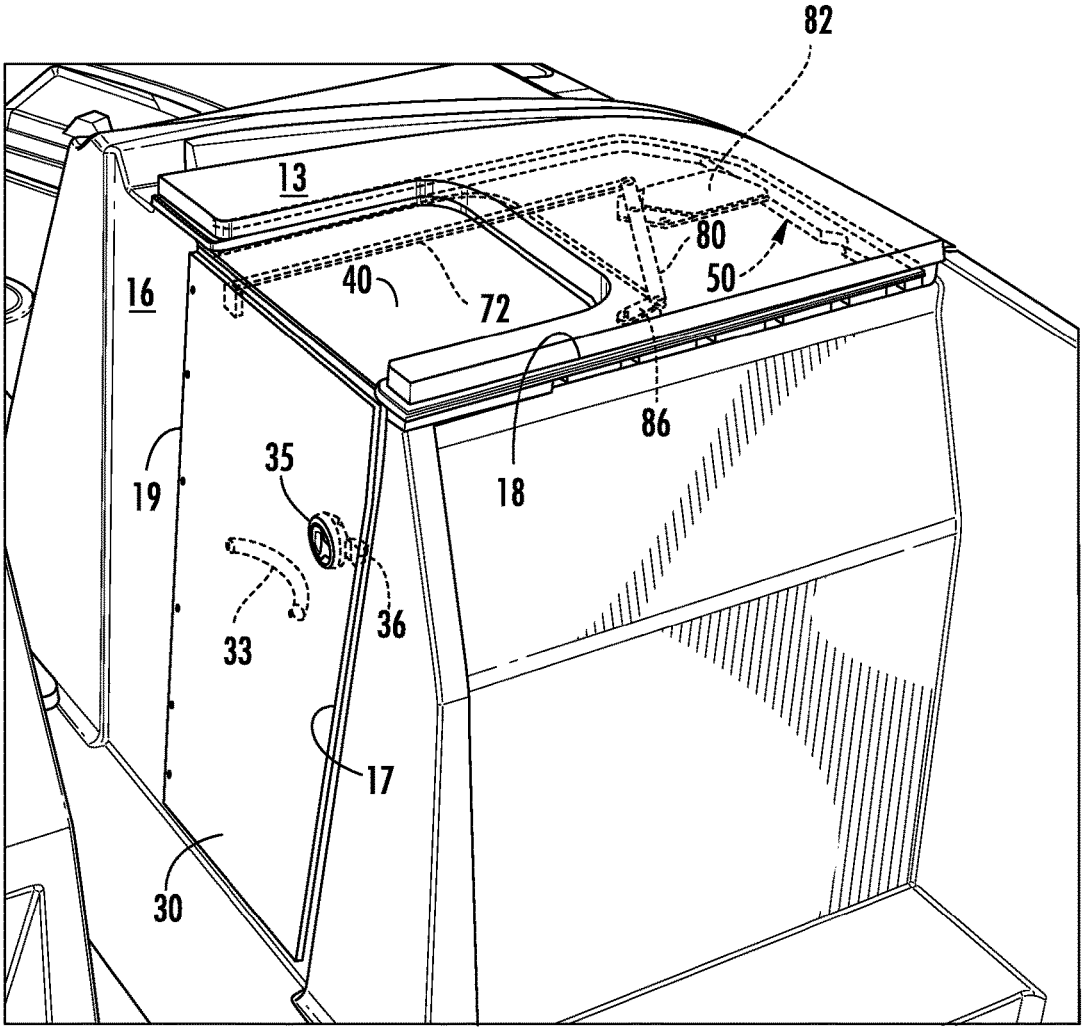
FIG. 3 is a fragmentary perspective view of the system shown in FIGS. 1 and 2 installed in a boat, showing the links between the door and hatch in phantom with both members shown in a closed position.
Figure 4:
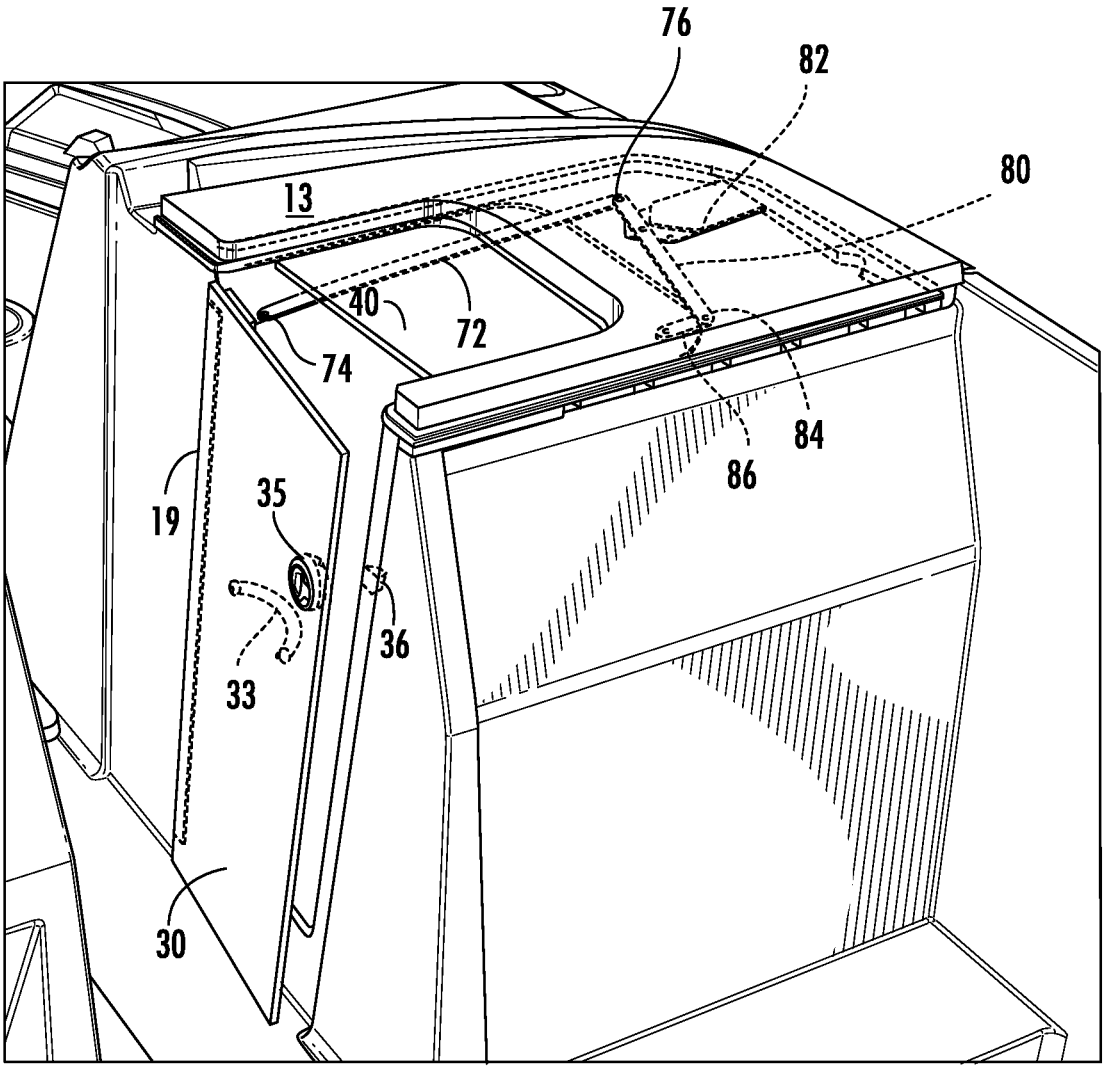
FIG. 4 is a view of the assembly shown in FIG. 3, shown with the door and hatch being partially open.

Referring initially to FIGS. 1 and 2, there is shown a vessel, such as a boat 10, having an upper deck 12 extending horizontally from the cockpit area 14 forwardly. The cockpit includes a vertical bulkhead 16. Deck 12 and bulkhead 16 include a vertically extending opening 17 and horizontally extending opening 18, which together define a companionway 20 (FIG. 2). The companionway 20 can be fully enclosed by a vertically pivoted door 30 and horizontally sliding hatch 40, as seen in FIGS. 1 and 3. In FIGS. 1 and 2, the deck section 13 (FIGS. 3-6) normally covering the hatch assembly 50 is not shown. In FIGS. 3-6, the links coupling the door 30 and hatch 40 are shown in phantom. Door 30 is pivotally mounted to the edge of bulkhead 16 adjacent companionway 20 by a hinge 19 (FIGS. 3-6 and 8). Door 30, when dosed, is secured with a conventional latching mechanism 35, with a bolt that engages a latch plate 36 (FIGS. 3, 4 and 6). When the door 30 is pivoted opened, if desired, it can be locked in an open position by a suitable latch mechanism (not shown). The inner side of the door may include a handle 33 to assist in closing the door 30 and hatch 40 from within the lower compartment 22 (FIG. 2).

Figure 5:
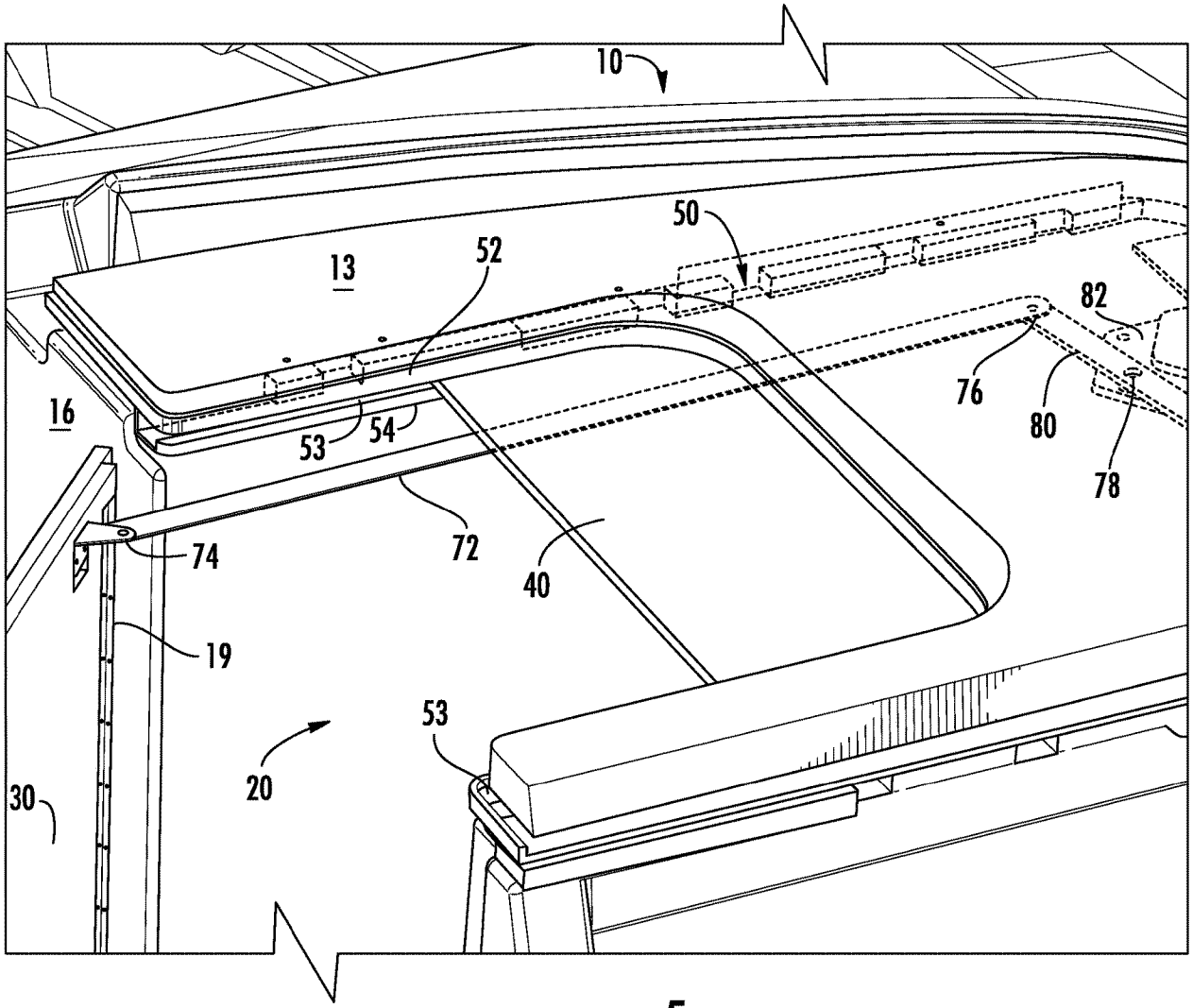
FIG. 5 is a greatly enlarged fragmentary view of the assembly shown in FIGS. 3 and 4, with the door and hatch moving toward a fully open position.
Figure 6:
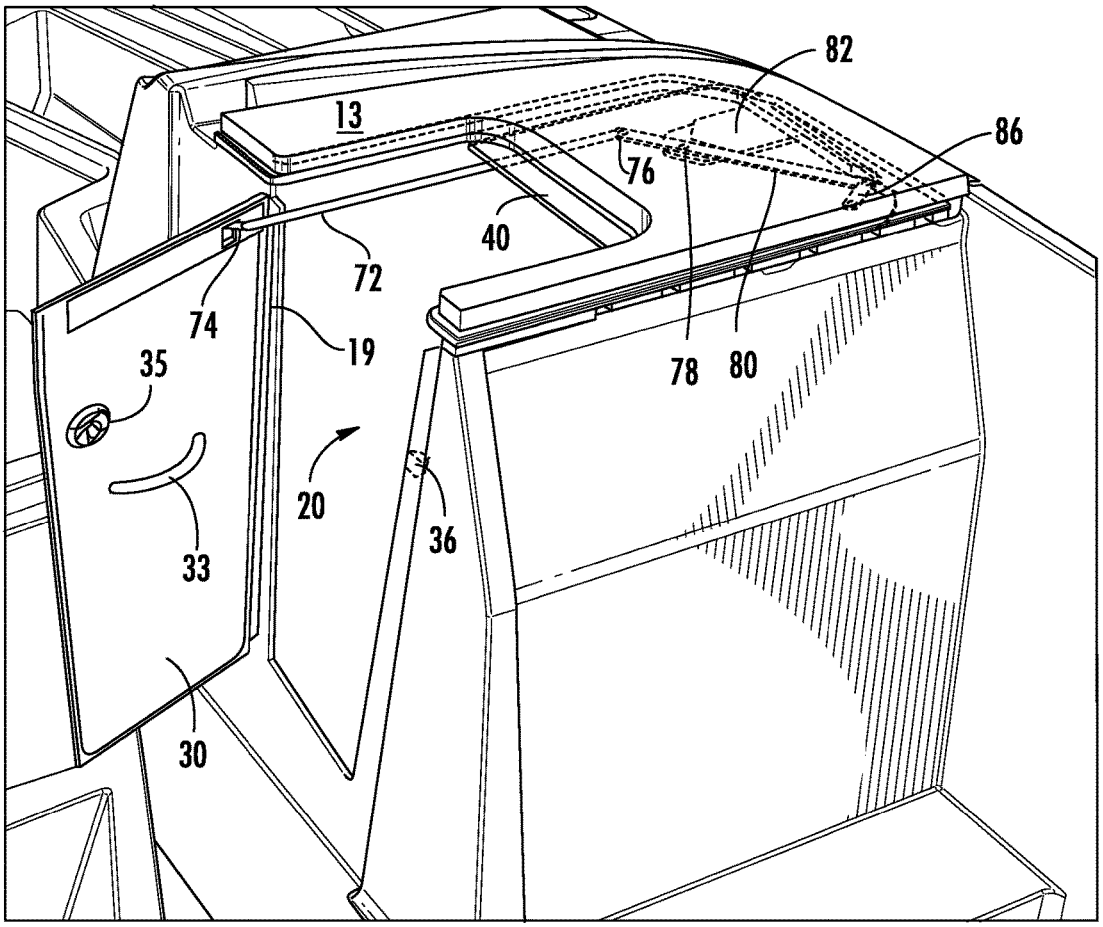
FIG. 6 is a view of the assembly shown in FIGS. 3-S, with the door and hatch in a near fully open position.

The hatch 40 is slideably mounted within a hatch assembly 50, as illustrated in FIGS. 1-6, and is mounted to the boat below the deck section 13, such that the hatch assembly, other than the hatch 40 itself, is substantially hidden from view. Assembly 50 comprises a frame 55 which includes upper and lower spaced apart guide plates 52 and 54 which are vertically spaced from one another to define parallel spaced-apart slots 53 (FIG. 5) for slideably receiving the planar sliding hatch 40. Hatch 40 can be made of a suitable material, such as Lexan®, fiberglass, wood, or the like, and may be transparent, tinted, or opaque, if desired, depending upon the particular effect the boat manufacturer desires. The hatch 40 is intercoupled with the door 30, as described in greater detail below in connection with FIGS. 7 and 8, such that, when the door is opened, the hatch slides open. Hatch 40 slides in the direction indicated by arrow A in FIG. 1 to a hatch storage area of the assembly 50, as seen in FIG. 2. This completely opens the vertical 17 and horizontal 18 openings forming the companionway 20 to provide access to the interior compartment 22 of the boat as seen in FIG. 2. Interconnection of the vertically pivoted door 30 to the horizontally slideable hatch 40 to achieve simultaneous movement of the door 30 and hatch 40 is now described in connection with FIGS. 7 and 8, which illustrate the linkage mechanism and its motion. FIGS. 4-6 also illustrate the movement of the linkage during movement of door 30 and hatch 40.

Figure 7:
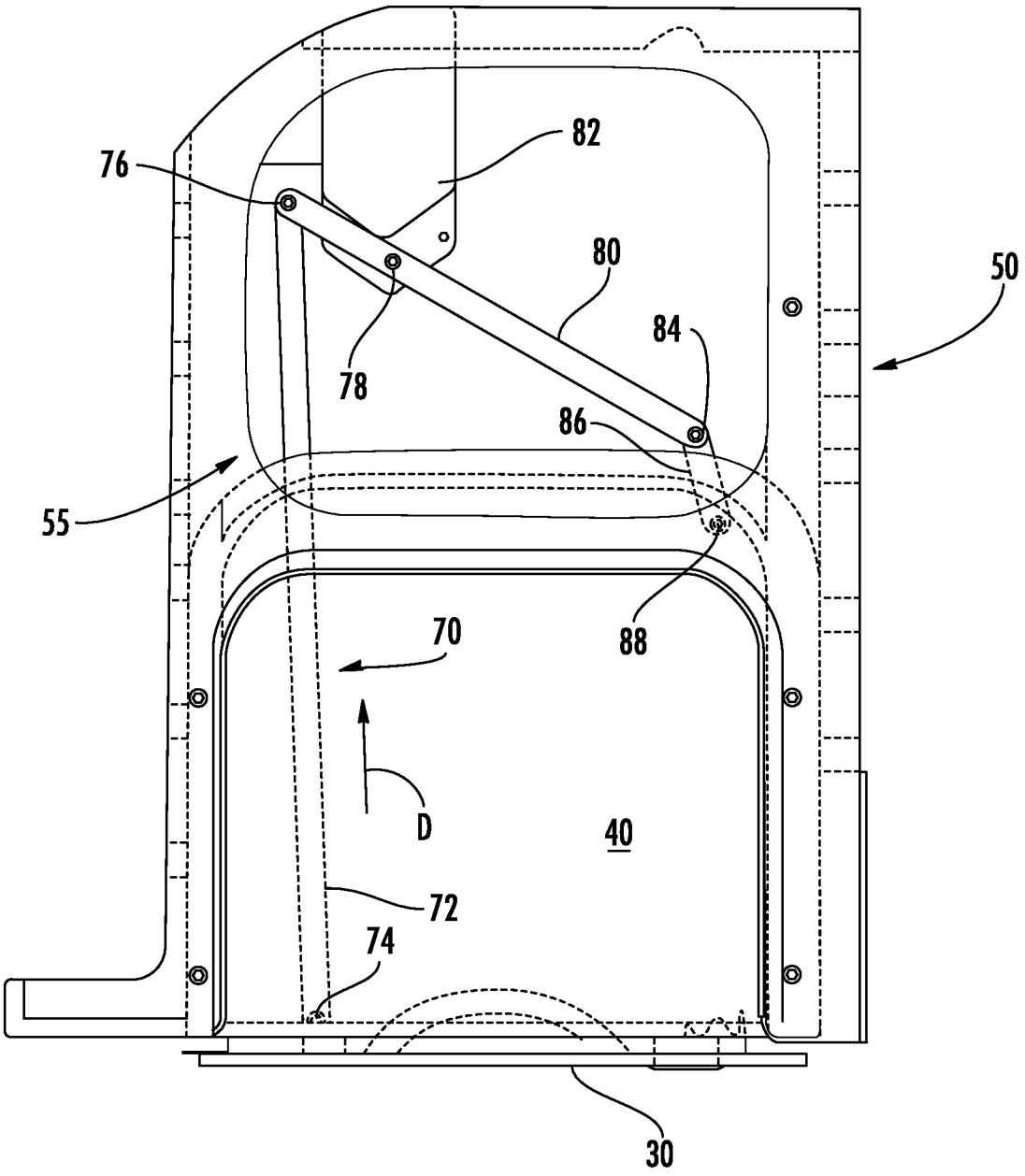
FIG. 7 is a top plan view of the assembly shown in FIGS. 3-6, showing the door and hatch fully closed and showing the links coupling the door and hatch in detail.
Figure 8:
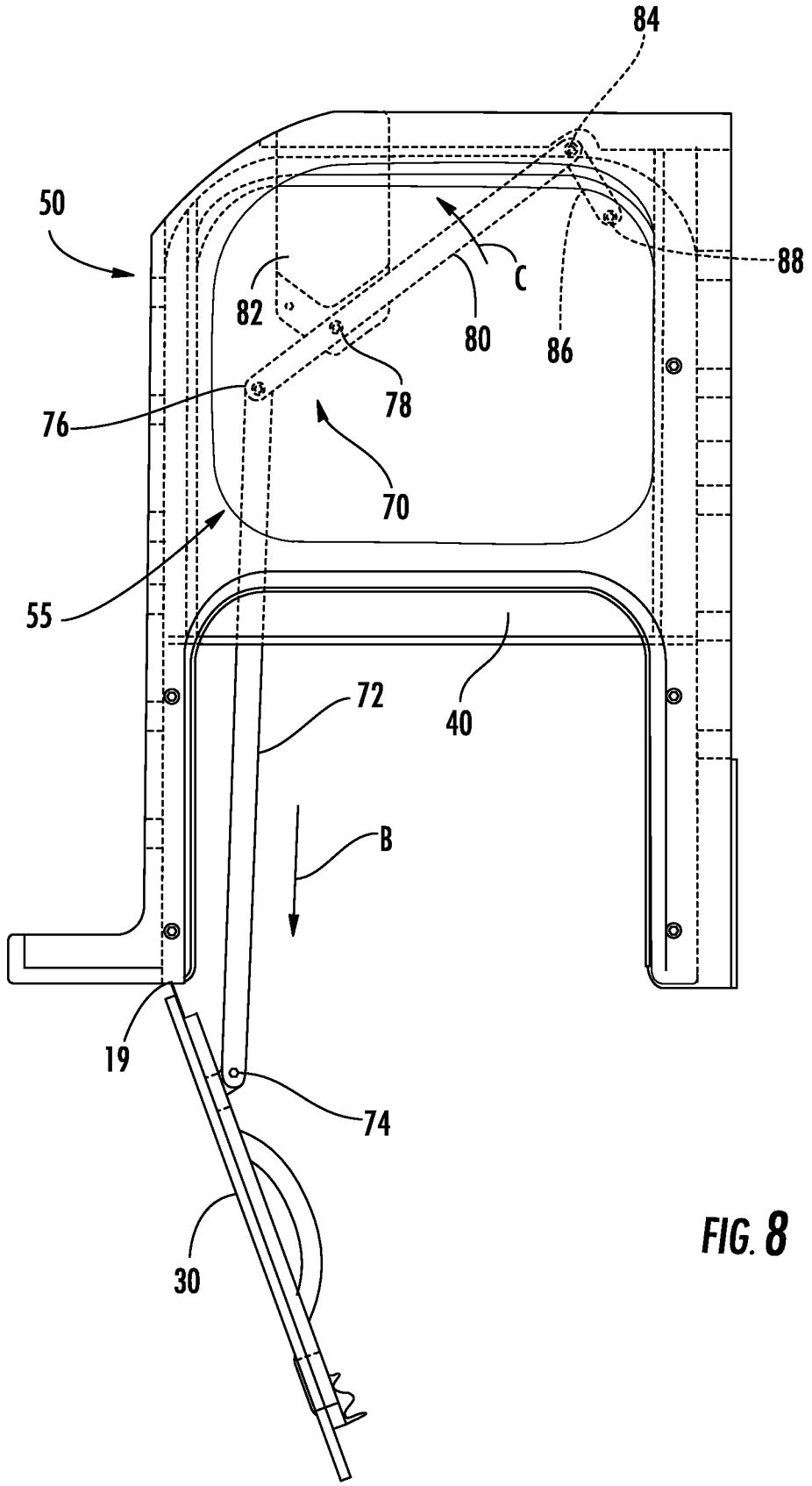
FIG. 8 is a top plan view of the structure of FIG. 7 showing the door and hatch in a nearly fully open position.

In FIG. 7, the hatch is shown in a closed position, as also illustrated in FIGS. 1 and 3. The linkage assembly 70 includes a first link 72 pivotally coupled at pivot coupling 74 to the inner edge of door 30 near hinge 19, as best seen in FIGS. 3-6 and 8. The opposite end of link 72 is pivotally coupled by pivot connection 76 to one end of a second link 80. Link 80 has an intermediate section which is pivotally coupled to a fixed bracket 82 by a pivot connection 78. The opposite end of link 80 is pivotally coupled to one end of a third link 86 by pivot connection 84. The opposite end of pivot link 86 is pivotally coupled to a leading corner of hatch 40 at pivot coupling 88. As door 40 is opened, link 72 is drawn rearwardly and moves in a direction indicated by arrow B in FIG. 8. This pivots link 80 in a counterclockwise motion around fixed pivot connection 78, as shown by arrow C in FIG. 8. The movement of the end of link 80 pivotally coupled to link 86 causes link 86 to pivot slightly in a clockwise direction to maintain the travel of hatch 40 in a parallel path in slots 53 between the guides 52 and 54 (FIG. 5).

When the companionway door 30 is closed, the sequence shown in FIGS. 3-6 is reversed. Link 70 moves forwardly, in the direction indicated by arrow D in FIG. 7, causing link 80 to move in a clockwise direction around pivot connection 78 pushing the hatch 40 toward a closed position. This, in turn, causes link 86 to move in a counterclockwise direction, with links 80 and 86 providing movement of the hatch 40 between open and closed positions, such that it maintains its parallel relationship in slots 53 within guides 52 and 54 to prevent sticking of the hatch as it is opened and closed by the motion of door 30, Thus, with the system of the present invention, the companionway 20 is readily accessible, including both the vertical and horizontally extending openings (17, 18), as door 30 is opened and automatically moves the hatch 40 to an open position to clear the companionway 20 for ingress and egress to the lower areas of the boat. With this invention, therefore, the companionway door and hatch are intercoupled to provide easy opening and closing of both the door and the hatch for facilitating access to the lower areas of the vessel without concern for multiple separate movements required by the vessel user.

It will become apparent to those skilled in the art that various modifications to the preferred embodiment of the invention as described herein can be made without departing from the spirit or scope of the invention as defined by the appended claims.

The invention claimed is:

1. A sliding hatch for a boat comprising:

a deck and bulkhead having an opening defining a companionway for access to areas below said deck, said companionway having vertical and horizontal open sections;

a door pivotally mounted to a bulkhead adjacent said vertical open section and movable for access to said vertical section of said companionway;

a hatch and a pair of spaced-apart slots for guidably supporting said hatch for linear sliding movement in a plane parallel to said deck for selectively opening and closing said horizontal section of said companionway; and pivot linkage coupling said door to said hatch, such that, as said door is opened, said hatch is moved to an open position.

2. The sliding hatch as defined in claim 1 wherein said linkage includes a first link having one end pivotally coupled to said door.

3. A sliding hatch for a boat comprising:

a deck and bulkhead having an opening defining a companionway for access to areas below said deck, said companionway having vertical and horizontal open sections;

a door pivotally mounted to a bulkhead adjacent said vertical open section and movable for access to said vertical section of said companionway;

a hatch slideably mounted to said deck for selective enclosing said horizontal section of said companionway; and pivot linkage coupling said door to said hatch, such that, as said door is opened, said hatch is moved to an open position, wherein said linkage includes a first link having one end pivotally coupled to said door, and said linkage includes a second link and a fixed bracket mounted to said deck forward of said horizontal opening, said second link pivotally mounted along its length to said fixed bracket and having one end pivotally coupled to an end of said first link remote from said door.

4. The sliding hatch as defined in claim 3 and further including a third link having one end pivotally coupled to a corner of said hatch and an opposite end pivotally coupled to an end of said second link remote from said fixed bracket.

5. The sliding hatch as defined in claim 4 wherein said hatch is a substantially planar member.

6. The sliding hatch as defined in claim 5 and further including a pair of parallel spaced-apart guides for slideably supporting said hatch.

7. The sliding hatch as defined in claim 6 wherein said guides include slots for receiving said hatch.

8. The sliding hatch as defined in claim 7 wherein said door and said hatch are made of one of a synthetic resinous composition, fiberglass, and wood.

9. A hatch assembly for a boat, said assembly having an opening defining a companionway for access to areas below the deck of said boat, said companionway having vertical and horizontal open sections and a door pivotally mounted to a bulkhead adjacent said vertical open section and movable for access to said vertical section of said companionway, comprising;

a frame mounted to said deck at edges of said horizontal open section, said frame including spaced-apart horizontally extending guides;

a hatch slideably mounted to said frame between said guides for selectively enclosing said horizontal section of said companionway; and pivot linkage coupling a door to said hatch, such that, as said door is opened, said hatch is linearly moved within said guides to an open position.

10. The assembly as defined in claim 9 wherein said linkage includes a first link having one end for pivotally coupling to a door.

11. A hatch assembly for a boat, said assembly having an opening defining a companionway for access to areas below the deck of said boat, said companionway having vertical and horizontal open sections and a door pivotally mounted to a bulkhead adjacent said vertical open section and movable for access to said vertical section of said companionway, comprising;

a frame mounted to said deck at edges of said horizontal open section, said frame including spaced-apart guides;

a hatch slideably mounted to said frame between said guides for selectively enclosing said horizontal section of said companionway; and pivot linkage coupling a door to said hatch, such that, as said door is opened, said hatch is moved to an open position, wherein said linkage includes a first link having one end for pivotally coupling to a door, and said linkage includes a second link having first and second ends and a fixed bracket mounted to said frame near one end of said horizontal opening, said second link pivotally coupled at a position intermediate said first and second ends to said fixed bracket and having said first end pivotally coupled to an end of said first link.

12. The assembly as defined in claim 11 and further including a third link having one end pivotally coupled to a corner of said hatch and an opposite end pivotally coupled to said second end of said second link remote from said fixed bracket.

13. The assembly as defined in claim 12 wherein said hatch is a substantially planar member slideably supported between said pair of parallel spaced-apart guides.

14. The assembly as defined in claim 13 wherein said guides include slots for receiving said hatch.

15. The assembly as defined in claim 14 wherein said hatch is made of at least one of a synthetic resinous composition, fiberglass, and wood.

16. A companionway access system for a boat having an opening defining a companionway for access to areas below the deck of the boat, wherein the companionway includes vertical and horizontal open sections, said system comprising;

a door pivotally mounted to a bulkhead of the boat adjacent the vertical open section and movable for access to the vertical section of said companionway;

a hatch and a pair of spaced-apart slots for guidably supporting said hatch for linear sliding movement in a plane parallel to the deck for selectively enclosing the horizontal section of the companionway; and a pivot linkage coupling said door to said hatch, such that, as said door is opened, said hatch is moved linearly to an open position.

17. The system as defined in claim 16 wherein said linkage includes a first link having one end pivotally coupled to said door.

18. A companionway access system for a boat having an opening defining a companionway for access to areas below the deck of the boat, wherein the companionway includes vertical and horizontal open sections, said system comprising;

a door pivotally mounted to a bulkhead of the boat adjacent the vertical open section and movable for access to the vertical section of said companionway;

a hatch slideably mounted to the deck for selectively enclosing the horizontal section of the companionway; and a pivot linkage coupling said door to said hatch, such that, as said door is open, said hatch is moved to an open position, wherein said linkage includes a first link having one end pivotally coupled to said door, and said linkage includes a second link and a fixed bracket mounted to the deck of the boat at an end of the horizontal opening, said second link pivotally mounted along its length to said fixed bracket and having one end pivotally coupled to an end of said first link remote from said door.

19. The system as defined in claim 18 and further including a third link having one end pivotally coupled to a forward corner of said hatch and an opposite end pivotally coupled to an end of said second link remote from said fixed bracket.

20. The system as defined in claim 19 wherein said hatch is made of a substantially planar member slideably supported between a pair of parallel spaced-apart guides.

21. The system as defined in claim 20 wherein said guides include slots for slideably receiving said hatch.

* * * * *